US006305124B1

(12) United States Patent
Pennington

(10) Patent No.: US 6,305,124 B1
(45) Date of Patent: Oct. 23, 2001

(54) REMOVABLE WINDOW GUARD

(76) Inventor: Tammy L. Pennington, 728 Bryson Way, Southlake, TX (US) 76092

( * ) Notice: Subject to any disclaimer, the term of this patent is extended or adjusted under 35 U.S.C. 154(b) by 0 days.

(21) Appl. No.: 09/487,415

(22) Filed: Jan. 18, 2000

(51) Int. Cl.[7] ..... E06B 3/68; E05C 21/02
(52) U.S. Cl. ..... 49/57; 49/465; 52/204.69
(58) Field of Search ..... 49/57, 50, 465, 49/463; 160/215, 327, 368.1, 380; 52/204.7, 476, 660, 764, 676, 202, 204.69, 208, 656.7

(56) References Cited

U.S. PATENT DOCUMENTS

| | | | | |
|---|---|---|---|---|
| 127,736 | * | 6/1872 | Brock | 52/656.7 X |
| 1,325,227 | * | 12/1919 | Blankennagel | 160/327 X |
| 2,222,667 | | 11/1940 | Kitzelman | 20/71 |
| 2,303,718 | | 12/1942 | Becker et al. | 20/71 |
| 2,459,884 | | 1/1949 | Kopf | 160/223 |
| 2,707,536 | * | 5/1955 | Wooten | 52/656.7 X |
| 2,722,722 | | 11/1955 | Mussman | 20/71 |
| 3,281,989 | | 11/1966 | Rosenblum | 49/57 |
| 4,250,601 | * | 2/1981 | Ward | 160/368.1 X |
| 4,677,791 | * | 7/1987 | Larson et al. | 49/463 |
| 5,396,732 | | 3/1995 | Andersen | 49/55 |
| 5,454,415 | | 10/1995 | Bolling et al. | 160/105 |
| 5,531,258 | * | 7/1996 | Poulson et al. | 49/57 X |
| 5,609,002 | * | 3/1997 | Fernandez | 49/50 X |
| 5,623,801 | * | 4/1997 | Drumbl | 49/463 X |
| 5,916,074 | | 6/1999 | Tracy | 49/141 |
| 5,916,105 | * | 6/1999 | Gow | 52/764 X |
| 6,044,892 | * | 4/2000 | Epstien | 160/380 |
| 6,050,893 | * | 4/2000 | Waite | 49/493 X |

* cited by examiner

*Primary Examiner*—Daniel P. Stodola
*Assistant Examiner*—Hugh B. Thompson
(74) *Attorney, Agent, or Firm*—Michael L. Diaz

(57) ABSTRACT

A removable window guard for preventing small children and animals from exiting a window. The window guard includes a barrier having a plurality of vertical members intersecting a plurality of horizontal members. On each side of the barrier is a plurality of axial extensions. Each axial extension has a knob. A plurality of brackets are affixed to the side of a window frame. Each bracket retains a knob within the bracket'interior, thereby securing the barrier to the window frame. The barrier may be easily removed from the bracket by an adult located on either side of the window.

3 Claims, 6 Drawing Sheets

REMOVABLE WINDOW GUARD

BACKGROUND OF THE INVENTION

1.Technical Field of the Invention

This invention relates to window barriers, and more particularly, to a removable window guard to prevent small children and animals from exiting through a window.

2.Description of Related Art

It is well known that there are many dangers facing small children in a house. One such hazard is an open window. Children may exit through a window, without the knowledge or supervision of an adult. Obviously, serious and sometimes tragic results can occur if a child falls through a window located on an upper floor.

Many devices have been used to prevent a child from exiting through a window. For example, window screens are sometimes used to provide a barrier to prevent children from exiting a window. However, window screens are used primarily to prevent insects from entering into a house. The window screens do not provide the structural strength necessary to confidently prevent small children from exiting out a window.

Additionally, window grills permanently affixed to the outside window frame have been utilized as a barrier. However, these window grills do not provide for quick and easy removal. Additionally, the window grills primarily prevent unauthorized entry into a house, and are not for the express purpose of preventing small children from leaving through a window. The window grills suffer from the disadvantage of being difficult to install, and equally difficult to remove. A barrier is needed which provides the structural support necessary to prevent children from exiting the window, easily removable from both sides of the window by an adult, and simple to operate and install.

Although there are no known prior art teachings of a solution to the aforementioned deficiency and shortcoming such as that disclosed herein, prior art references that discuss subject matter that bears some relation to matters discussed herein are U.S. Pat. No. 2,222,667 to Kitzelman (Kitzelman), U.S. Pat. No. 5,396,732 to Andersen (Andersen), U.S. Pat. No. 5,454,415 to Boiling et al. (Bolling), and U.S. Pat. No. 5,916,074 to Tracy (Tracy).

Kitzelman discloses a removable grill attached to a window frame. The grill includes a plurality of vertical bars welded to a plurality of horizontal bars. The left-hand ends of the horizontal bars include a series of hinge devices for affixing the horizontal bars to the window frame. The right-hand ends of the horizontal bars are attached through a sleeve which is held in place by screws. The grill may be removed by unscrewing the screws on the sleeve of each horizontal bar. Kitzelman does not teach or suggest an easily removable window guard. Kitzelman merely discloses a grill which is permanently attached to a window. Kitzelman suffers from the disadvantage of the window grill being difficult to remove, such as during a time of an emergency.

Andersen discloses a safety barrier adapted to be removably secured between two opposing supports. The barrier includes a frame structure and an openable gate. The frame structure includes a rigid lower horizontally extending beam and a vertically extending pillar located on a side of the beam. The gate is hinged to one side of the pillar and to a grid on the other side. The frame structure is secured between supports by expanding securing means, with the gate having a locking device expandable against one of the supports. Andersen suffers from the disadvantage of utilizing an expanding securing means which does not securely and safely affix the barrier to the opposing supports. A child may apply enough force to push the barrier away from the supporting members.

Bolling discloses a child safety window screen for preventing a child from falling through a window. The safety window screen includes an elongated top rail extended across a frame of an opened window, an elongated bottom rail offset from the top rail and extended across a frame of an open window, and a screen coupled between the top rail and bottom rail to create an extended configuration of shielding for an open window. However, Bolling does not teach or suggest a means for easily removing the safety screen from the window. Bolling merely discloses affixing the safety screen to the window with screws.

Tracy discloses a window guard having a pair of mounting brackets mounted to the window. In addition, end caps are interconnected to a first wire subassembly and a second wire subassembly. The end caps are removably attached to the first and second mounting brackets. The first and second wire subassemblies are slidably interconnected allowing the window guard to fit many different sized openings. At least one emergency release button mounted on the first mounting bracket and engaging the end cap allows for disassembly of the window guard in emergency exit situations. Tracy does not teach or suggest a simple means for securely affixing the window guard to the window frame. Tracy discloses complicated and expensive brackets to affix the window guard to the window frame. Additionally, Tracy does not teach or suggest a simple means of removing the window guard from outside the window. Tracy discloses an emergency release button which is only accessible from inside the house, preventing emergency personnel outside the window, from removing the window guard.

Review of each of the foregoing references reveals no disclosure or suggestion of an apparatus as that described and claimed herein. Thus, it would be a distinct advantage to have a simple and inexpensive apparatus which prevents children from exiting through a window, while being easily removable from either side of the window. It is an object of the present invention to provide such an apparatus.

SUMMARY OF THE INVENTION

In one aspect, the present invention is a removable window guard. The window guard includes a barrier covering a width of the window. The barrier has two vertical edges located on each end of the barrier and a plurality of axial extensions located on the two vertical edges. Each axial extension has a knob located on an end of the axial extension. The window guard also includes a means for securing the plurality of knobs to the window.

In another aspect, the present invention is a removable window guard. The window guard includes a barrier covering a width of the window. The barrier has a plurality of horizontal members and a plurality of vertical members intersecting the plurality of horizontal members. The barrier also includes two vertical edges located on each end of the barrier and a plurality of axial extensions located on each vertical edge. Each axial extension has a knob located on an end of said axial extension. The window guard also includes a plurality of brackets affixed to a side window frame of the window. Each bracket is positioned on the side window frame for holding one knob. In addition, each bracket has a slot for holding the axial extension and an interior area for accommodating the knob. The window guard also includes a retaining means for holding the knobs within the plurality of brackets.

In still another embodiment, the present invention is a removable window guard. The window guard includes a barrier having a first vertical edge and a second vertical edge. The first vertical edge and the second vertical edge are located on each lateral end of the barrier. The window guard also includes a first upper axial extension extending laterally out from an upper portion of the first vertical edge. The first upper axial extension has a first knob. A second upper axial extension extends laterally out from an upper portion of the second vertical edge and has a second knob. A first lower axial extension extends laterally out from a lower portion of the first vertical edge and has a third knob. In addition, a second lower axial extension extends laterally out from a lower portion of the second vertical edge and includes a fourth knob. The window guard also includes a bracket for removably holding each knob to a window frame of the window. Additionally, the first and second knobs are held in place within their respective brackets by a retaining means.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A removable window guard to prevent small children and animals from exiting through a window is disclosed.

Figure 1:
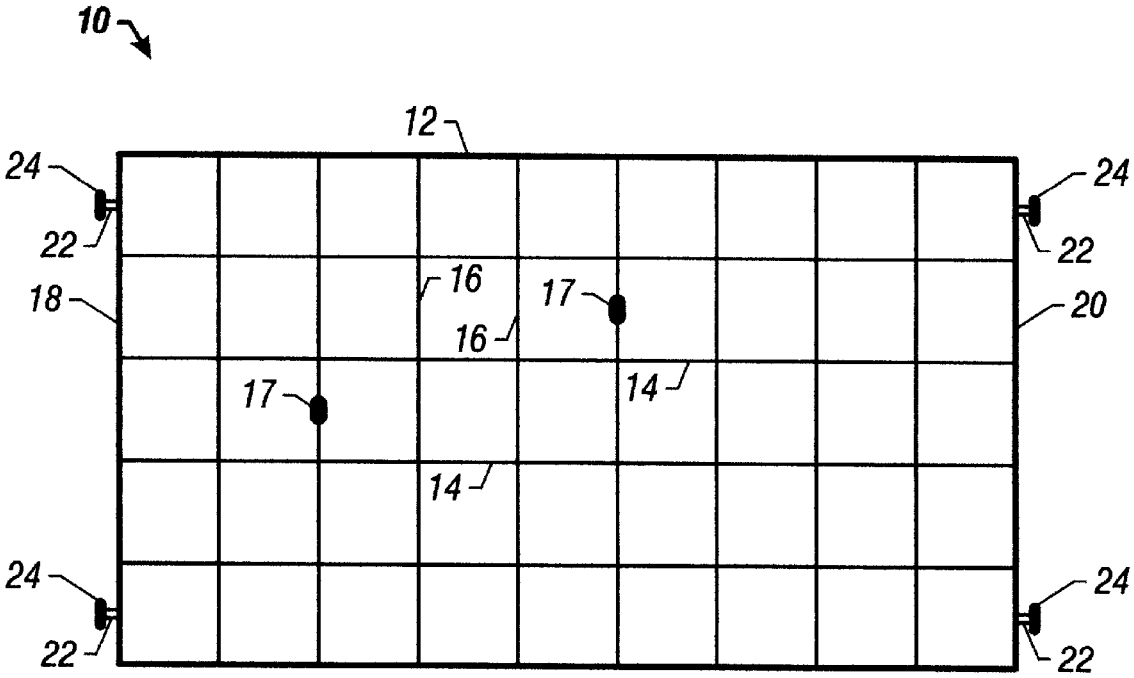
FIG. 1 is a front view of a window guard in the preferred embodiment of the present invention.

FIG. 1 is a front view of a window guard 10 in the preferred embodiment of the present invention. The window guard includes a barrier 12 having a plurality of horizontal members 14 and a plurality of vertical members 16. The horizontal and vertical members are connected at each point where the members intersect and form a grid pattern. In the preferred embodiment of the present invention, the horizontal and vertical members are constructed of a mesh material, to allow for maximum ventilation through an opened window to which the window guard is affixed. In alternate embodiments, the barrier may be one solid sheet of material. A plurality of clips 17 may optionally be secured to the vertical or horizontal members.

A plurality of axial extensions 22 are affixed to the outermost edges 18 and 20 of the barrier 12. Each axial extension ends in a knob 24. In the preferred embodiment, two knobs are positioned on an upper portion of the barrier 12 and two knobs are positioned on a lower portion of the barrier.

Figure 2:
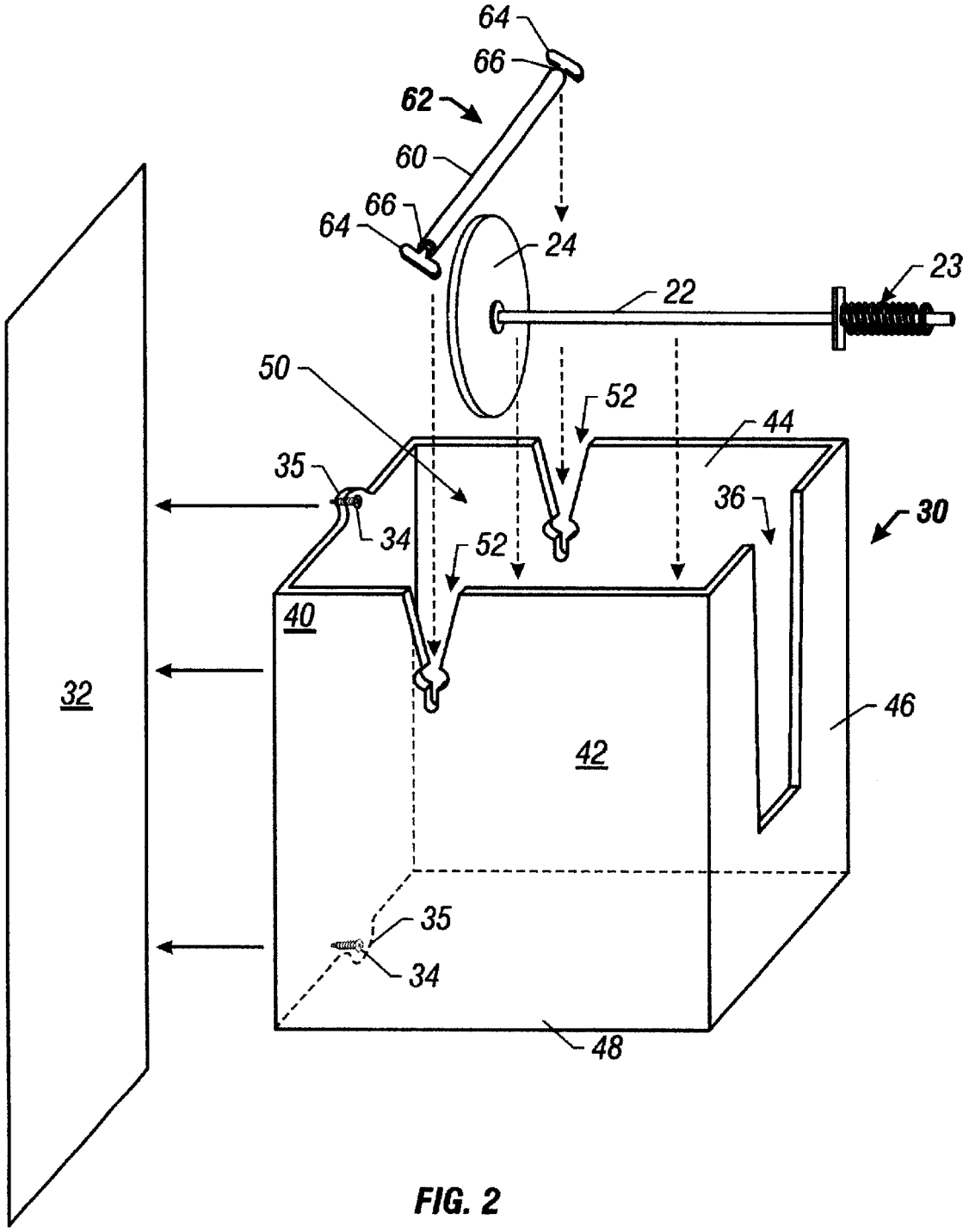
FIG. 2 is a front exploded perspective view of a securing bracket, the knob, and a retaining pin in the preferred embodiment of the present invention.

FIG. 2 is a front exploded perspective view of a securing bracket 30, the knob 24, and a retaining pin 60 in the preferred embodiment of the present invention. The securing bracket is affixed to a side window frame 32. The securing bracket may be attached by a plurality of screws 34 or any other means which will securely fasten the securing bracket to the side window frame, such as an epoxy glue.

The securing bracket 30 includes a side panel 40, two face panels 42 and 44, an interior panel 46 and a bottom panel 48. In the preferred embodiment of the present invention, the panels intersect to form a rectangularly-shaped container having an interior 50. However, the panels may be any size and shape which is able to accommodate the knob 24 within the interior. The side panel is preferably affixed to the side window frame 32 by the screws 34. In the preferred embodiment, the screws are positioned on two extensions 35 located on an upper and lower edge of the side panel. The interior panel includes a retaining slot 36 having a width and height large enough to accommodate the axial extension 22.

The securing bracket 30 also includes a grooved slot 52 for holding the retaining pin 60 positioned on each face panel 42 and 44. The grooved slot is shaped to hold the retaining pin in place when positioned at its bottom-most position.

The retaining pin includes a main body 62, and two protuberances 64 having narrowed necks 66 located on each end of the main body. The shape of the retaining pin allows the pin to be "snapped" into position within the grooved slot 52 of face panel 42 and face panel 44. Force is necessary to remove or install the retaining pin within the grooved slot.

To secure the knob 24 within the upper securing bracket 30, the knob 24 and axial extension 22 are placed within the retaining slot 36. The knob must be laterally positioned far enough within the interior 50 of the securing bracket to be between the side panel 40 and the grooved slot 52. Additionally, the grooved slot 52 is laterally positioned on each face panel to allow the knob to fit within the bracket. In the preferred embodiment, the grooved slot is positioned at least half the width of the face panel away from the side window frame 32. To hold the knob securely in place, the retaining pin is then snapped into position within the grooved slot.

Figure 3:
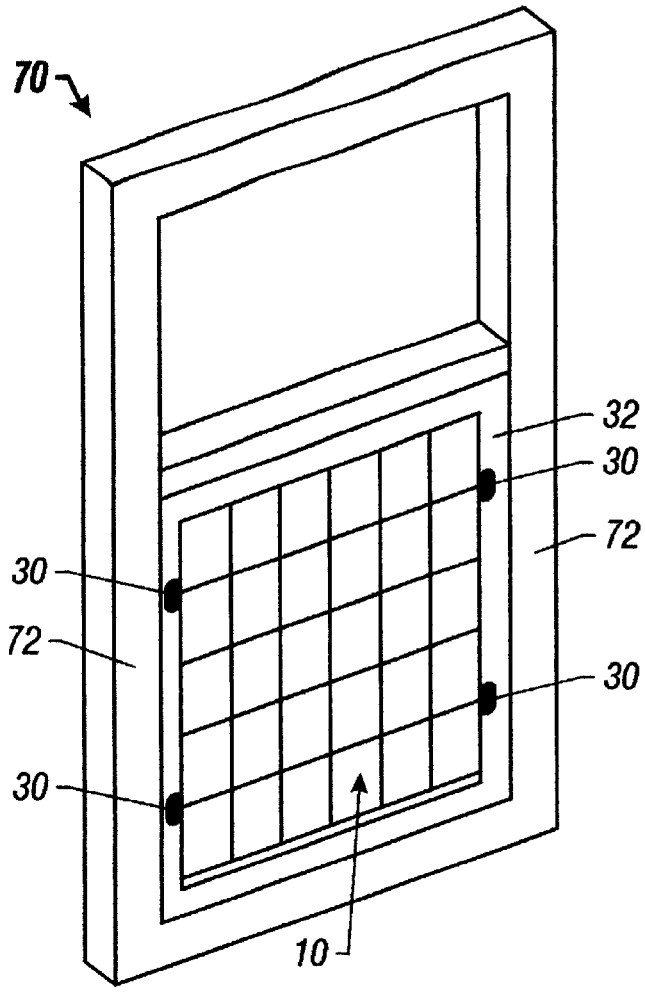
FIG. 3 is a front perspective view of the window guard mounted within a window in the preferred embodiment of the present invention.

FIG. 3 is a front perspective view of the window guard 10 mounted within a window 70 in the preferred embodiment of the present invention. The window guard is mounted as discussed above by using the securing brackets to secure the window guard to the window. The securing brackets are affixed to each side window frame 32 of the window. In alternate embodiments, the securing brackets may be affixed to the outer edges 72 of the window frame.

The securing brackets are used to secure the upper knobs of the window guard 10 to the window frame 32. The bottom knobs may be positioned within the securing bracket. However, since the upper knobs are secured within the securing brackets by the retaining pins 60, the lower securing brackets do not have to be secured by retaining pins. In addition, by only utilizing the retaining pins on the upper knobs, the window guard can be more easily removed from the window frame.

Referring to FIGS. 1–3, the operation of the window guard 10 will now be explained. The securing brackets 30 are affixed to the side window frames 32 of the window 70, preferably by the screws 34. The number and placement of the securing brackets correspond with the number and placement of the knobs 24 on the window guard. The knobs and axial extensions 22 are positioned within the retaining slots 36. Each knob must be laterally positioned between the side panel 40 and the grooved slot 52. On the upper knobs, the retaining pin for each securing bracket is snapped into the bottom-most position of the grooved slot. The upper knobs 24 are unable to be removed because the retaining pins restrict the movement of each knob within the interior 50 of the securing brackets. A child is unable to remove the window guard because he lacks the strength and the coordination to remove the retaining pin. Additionally, the window guard is securely mounted to the window 70 and able to withstand any force by a small child attempting to remove the window guard from the window.

When an adult wishes to remove the window guard 10 from the window 70, the retaining pin is removed from the grooved slot. Although some force is necessary to "unsnap"the retaining pin from the grooved slot, it is not a difficult task for an adult. In addition, the retaining pin may be removed by an adult located on either side of the window, which allows emergency personnel located on the outside to easily and quickly remove the window guard from the window when necessary. Once the retaining pins have been removed, the window guard is lifted from the securing brackets and removed from the window 70.

Figure 4:
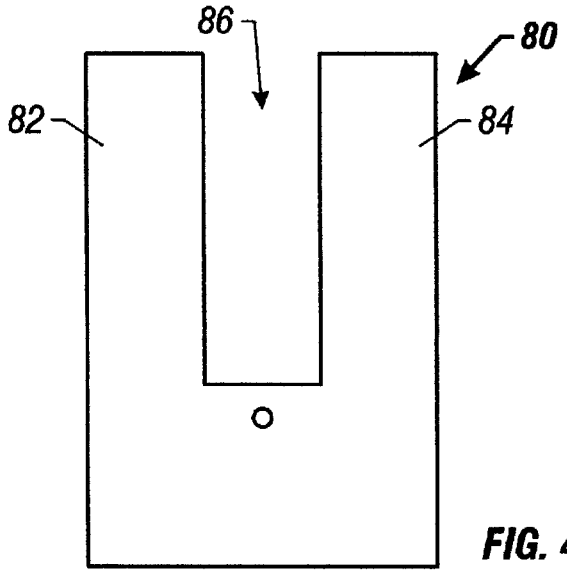
FIG. 4 is a side elevational view of a geared securing bracket in a first alternate embodiment of the present invention.

FIG. 4 is a side elevational view of a geared securing bracket 80 in a first alternate embodiment of the present invention. The geared securing bracket includes a forward panel 82 and a rear panel 84, both forming a slot 86.

Figure 5:
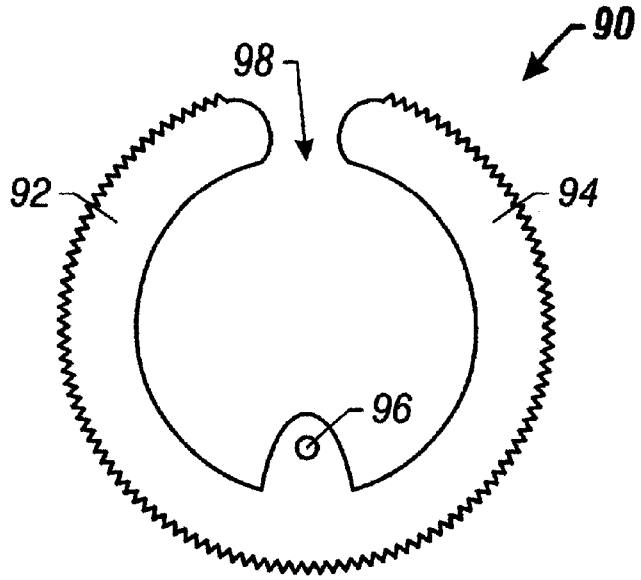
FIG. 5 is a side elevational view of a gear of the geared securing bracket in the first alternate embodiment of the present invention.

FIG. 5 is a side view of a gear 90 of the geared securing bracket 80 in the first alternate embodiment of the present invention. The gear 90 is circularly shaped and includes a forward arm 92 and a rear arm 94, each arm having gear teeth. At the base of the gear is a rod 96 for attaching the gear to the geared securing bracket. The forward arm and rear arm do not connect, thereby providing an open space 98.

Figure 6:
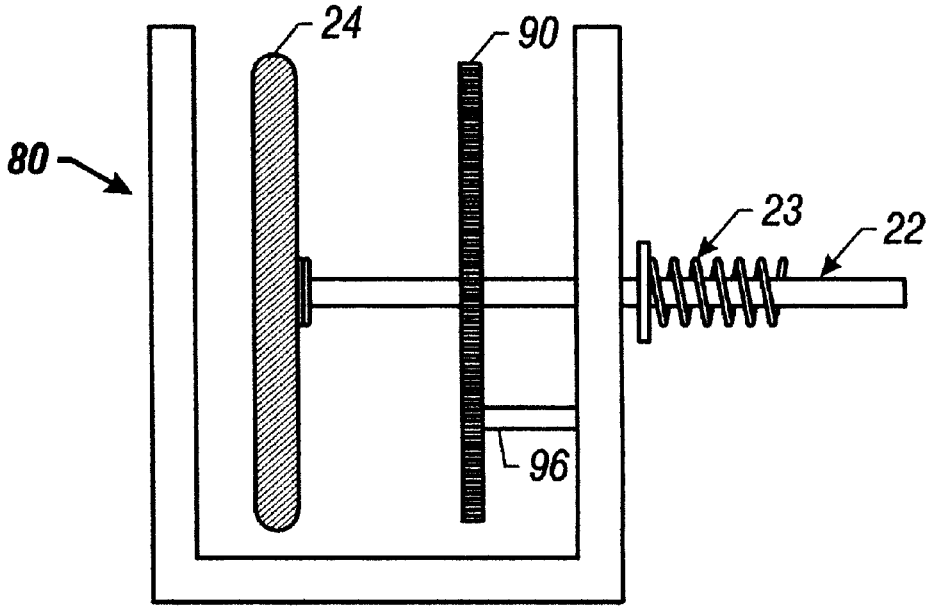
FIG. 6 is a front view of the geared securing bracket with the knob positioned within the slot in the first alternate embodiment of the present invention.
Figure 7:
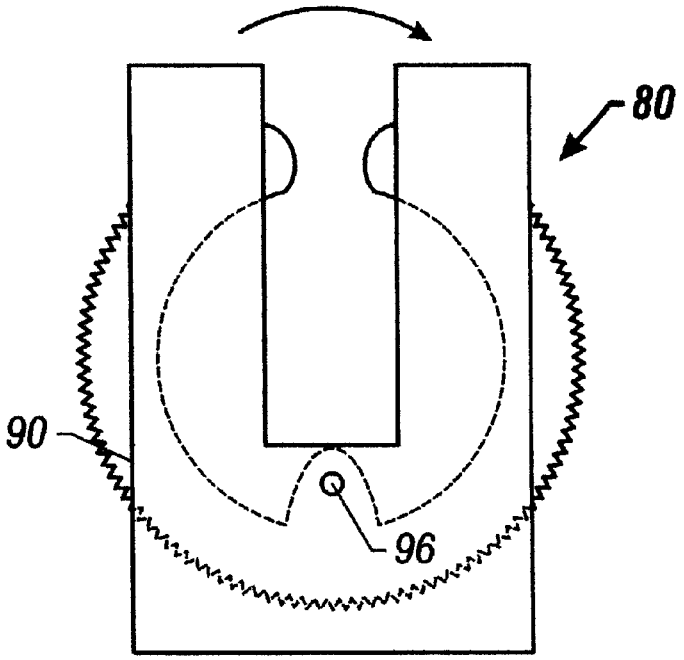
FIG. 7 is a side elevational view of the geared securing bracket with the gear in the first alternate embodiment of the present invention.

FIG. 6 is a front view of the geared securing bracket 80 with the knob 24 positioned within the slot 86 in the first alternate embodiment of the present invention. FIG. 7 is a side elevational view of the geared securing bracket 80 with the gear 90 in the first alternate embodiment of the present invention.

FIGS. 4–7 illustrate an alternate embodiment of the present invention utilizing the geared securing bracket 80 and gear 90. The knob 24 is positioned within the geared securing bracket by laying the axial extension 22 within the slot 86. In order to accept the axial extension within the slot, the gear must be positioned with the open space 98 facing upwards as illustrated in FIG. 7. When the axial extension is positioned within the slot, the gear is rotated, moving the open space away from the slot, thereby locking the axial extension within the geared securing bracket. The gear includes a plurality of teeth allowing easy rotation of the gear. The geared securing brackets are positioned on the side window frame to accommodate each knob 24 of the window guard 10.

Figure 8:
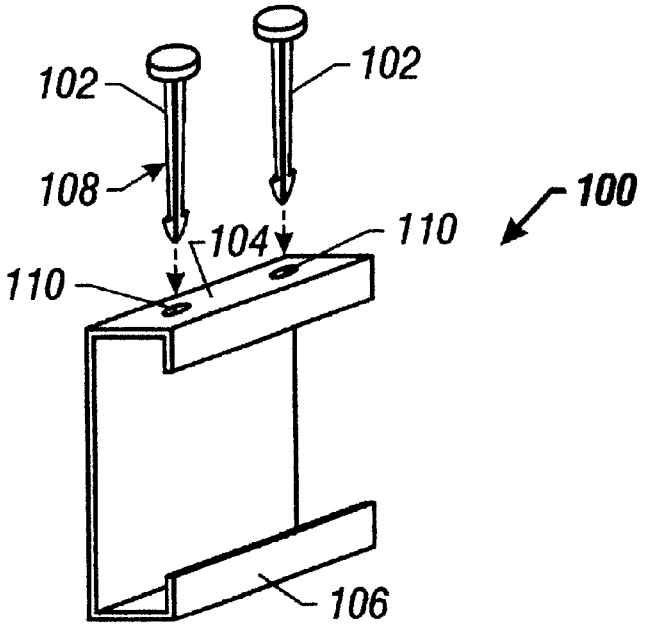
FIG. 8 is a front perspective view of a track having securing pins in a second alternate embodiment of the present invention.

FIG. 8 is a front perspective view of a track 100 having securing pins 102 in a second alternate embodiment of the present invention. The track 100 is positioned on the side window frame 32. The track includes an upper lip 104 and a lower lip 106. Each upper and lower lip provides a recess to accommodate a corresponding upper and lower edge of the knob. The track is at least slightly longer than the width of the knob. Two securing pins are used to secure the knob 24 in place within the track. The securing pins preferably include a split body 108 with a barbed end. The securing pin is placed within an aperture 110 located on the upper lip and an aperture (not shown) located on the lower lip. The split body must have its split body pressed together to pass through each aperture. Once the split body is released, the split body spreads out, preventing the securing pin from being dislodged through the apertures. Although a split-bodied pin is described, any type of securing pin may be utilized to prevent longitudinal movement of the knob within the track.

Figure 9:
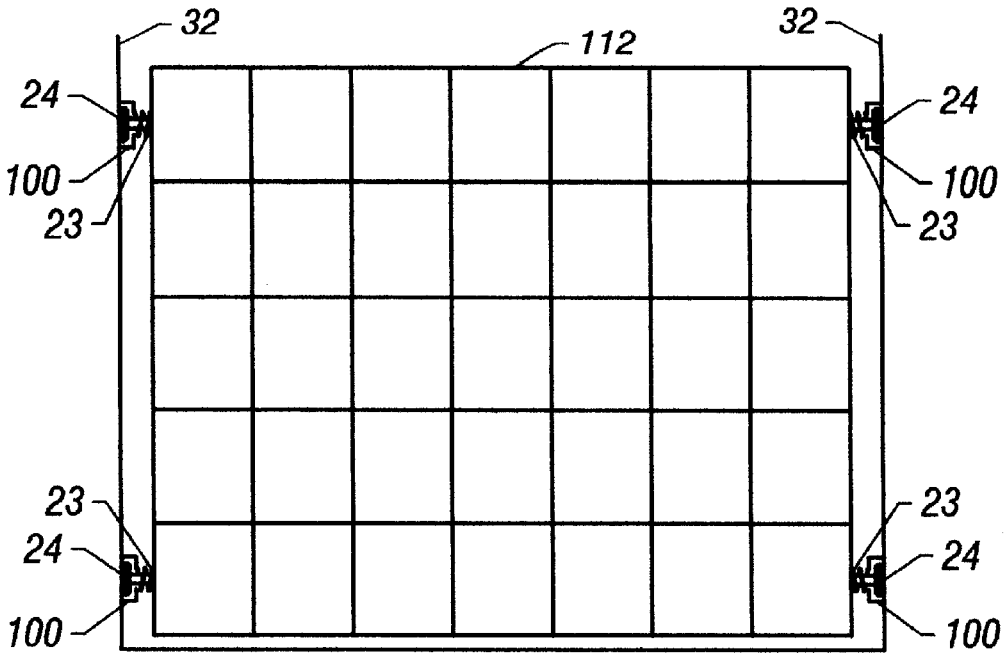
FIG. 9 is a front view of the window guard affixed to the window frame in the second alternate embodiment of the present invention.

FIG. 9 is a front view of the window guard 10 affixed to the window frame 32 in the second alternate embodiment of the present invention. FIGS. 8 and 9 describe the second alternate embodiment of securing the window guard 10 to the window 70. The knobs are slid within the recesses formed by each upper and lower lip of the track 100. The knobs are held in place by the securing pins 102. If desired, the window guard may be removed from either side by removing one securing pin from each track, allowing the knob to slide out of its track.

Figure 10:
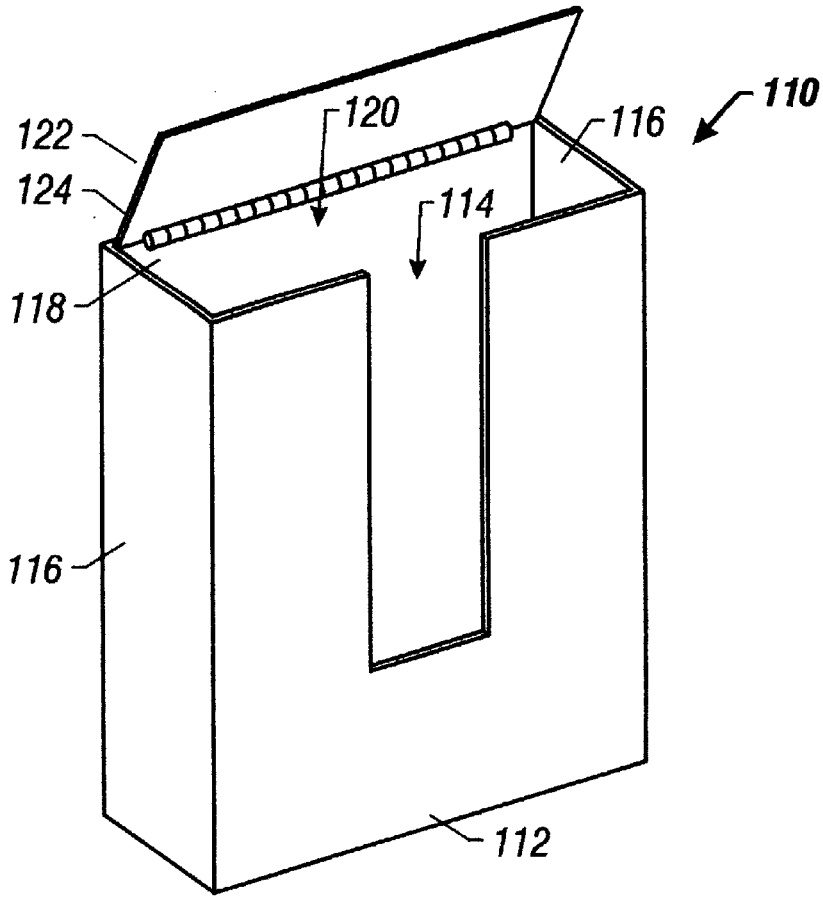
FIG. 10 is a front perspective view of a retaining bracket in a third alternate embodiment of the present invention.

FIG. 10 is a front perspective view of a retaining bracket 110 in a third alternate embodiment of the present invention. The retaining bracket includes a interior panel 112 having a slot 114, two face panels 116, and a side panel 118. All the panels form an interior 120 large enough to accommodate the knob 24. The slot 114 faces inwards toward the window guard 10 and is large enough to hold the axial extension 22. The side panel is adjacent to the side window frame 32. The retaining bracket is affixed to the side window frame by screws or any alternate means which securely mounts the retaining bracket to the side window frame.

The retaining bracket also includes a lid 122 affixed to the upper portion of the panels. The lid includes a spring hinge 124, which presses the lid to the closed position (horizontally positioned on top of the panels). The lid may be raised by applying upward force to the lid.

When securing the knob within the retaining bracket, the knob is placed within the interior 120. Access to the interior of the retaining bracket is gained by applying upward force to the lid 122, thereby raising the lid. The axial extension rests within the slot 114. The lid is then released, pressing the lid shut against the top of the panels. The knob is then retained within the retaining bracket. A small child is unable to remove the window guard, because the force necessary to raise the lid of the retaining bracket is too great for a small child. If the window guard needs to be removed, the lid is raised and the knob is removed from the interior of the retaining bracket. The lid is only required for the upper retaining brackets affixed to the side window frame. The lower retaining brackets do not require the lid. However, the lower retaining brackets must include a slot to position each axial extension of the lower knobs within its interior. Although a bracket and track have been described to retain the knobs of the window guard in place, it should be understood that other devices may also be utilized to securely fasten the window guard to a window, while still allowing quick and simple removal of the window guard, without departing from the scope of the present invention.

The window guard may be made to fit any size window. In the preferred embodiment, the window guard is expandable. In one embodiment, the barrier includes overlapping material allowing the expansion of the width of the barrier. The plurality of clips 17 may be used to secure the overlapping material of the barrier with an underlying section of the barrier. In another embodiment, the horizontal members 14 may telescopically extend outwardly to accommodate various window sizes. In still another embodiment, the axial extensions 22 may be spring loaded to vary the length of the axial extensions and the width of the window guard. In FIGS. 2, 6, and 9, a spring 23 is wound around the axial extension 22.

The window guard provides many advantages over existing guards. The window guard provides a secure barrier preventing small children from exiting out a window. In addition, the barrier is easy to install, providing a simple and inexpensive method of preventing children from exiting a window. Additionally, the window guard is easily removable by an adult, providing the removal of the window guard from either side of the window. The window guard is also portable, allowing easy transportation and storage of the barrier. Although the window guard is used primarily to prevent small children from exiting or falling out a window, the window guard is also effective in preventing an animal, such as a dog, from exiting through the window.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A window guard and window combination for preventing small children from exiting a window, the combination comprising:

a window having a side window frame;

a barrier covering a width of the window, said barrier having:

two vertical edges located on each end of the barrier;

a plurality of axial extensions located on the two vertical edges, each axial extension having a knob located on an end of said axial extension; and means for securing the plurality of knobs to the window, wherein said means for securing the plurality of knobs includes:

a plurality of brackets affixed to the side window frame of the window, each bracket positioned on the side window frame for holding one knob; and retaining means for holding the plurality of knobs within the plurality of brackets, wherein the retaining means for holding the plurality of knobs within the plurality of brackets includes a lid hinged to an upper portion of each bracket.

2. A window guard and window combination for preventing small children from exiting a window, the combination comprising:

a window having a side window frame;

a barrier covering a width of the window, said barrier having:

two vertical edges located on each end of the barrier;

a plurality of axial extensions located on the two vertical edges, each axial extension having a knob located on an end of said axial extension; and means for securing the plurality of knobs to the window, wherein said means for securing the plurality of knobs includes:

a plurality of brackets affixed to the side window frame of the window, each bracket positioned on the side window frame for holding one knob; and retaining means for holding the plurality of knobs within the plurality of brackets, wherein the retaining means for holding the plurality of knobs includes a plurality of rotatable gears, each gear having a slot large enough to accommodate the axial extension, whereby the gear is rotated to lock each knob in position within the plurality of brackets.

3. A window guard and window combination for preventing small children from exiting a window, the combination comprising:

a window having a side window frame;

a barrier covering a width of the window, said barrier having:

two vertical edges located on each end of the barrier;

a plurality of axial extensions located on the two vertical edges, each axial extension having a knob located on an end of said axial extension; and means for securing the plurality of knobs to the window, wherein said means for securing the plurality of knobs includes:

a plurality of tracks affixed to the side window frame of the window, each track forming a recess with an adjacent parallel track to accommodate and retain a knob between each track and the adjacent parallel track;

a plurality of securing pins preventing each knob positioned within a plurality of tracks from moving longitudinally, each securing pin positioned perpendicularly across the track.

* * * * *